United States Patent [19]

Kane

[11] 4,403,714

[45] Sep. 13, 1983

[54] COLLAPSIBLE TUBE COMPRESSING PASTE DISPENSER

[76] Inventor: David M. Kane, 1238 Goldenrod Dr., Garland, Tex. 75043

[21] Appl. No.: 329,305

[22] Filed: Dec. 10, 1981

[51] Int. Cl.[3] ..... B65D 35/28

[52] U.S. Cl. ..... 222/101

[58] Field of Search ..... 222/76, 101, 102, 105, 222/96; 401/152, 155, 156

[56] References Cited

U.S. PATENT DOCUMENTS

| | | | |
|---|---|---|---|
| 2,712,400 | 7/1955 | Stauffer | 222/96 |
| 3,232,488 | 2/1966 | Headberg | 222/101 |
| 3,581,943 | 6/1971 | Koenigshof et al. | 222/102 |
| 3,738,533 | 6/1973 | Bertrand | 222/102 |
| 3,860,147 | 1/1975 | Vessio et al. | 222/96 |
| 4,125,206 | 11/1979 | Wilson | 222/101 |
| 4,132,330 | 1/1979 | Rauscher et al. | 222/76 |
| 4,234,104 | 11/1980 | Apuzzo, Jr. et al. | 222/94 |

*Primary Examiner*—Stanley H. Tollberg

*Attorney, Agent, or Firm*—Robert G. Boydston

[57] ABSTRACT

This invention provides a simplified device for dispensing paste materials from collapsible tube packages, such as the familiar toothpaste tube. A roller, actuated by an electric motor driven lead screw, compresses a tube within a cabinet to expell a desired quantity of the paste materials. A dispensing adapter provides for use of the invention with any common size of tube dispensing nipple and an adapter nozzle closure also serves as a motor switch actuation element.

1 Claim, 6 Drawing Figures

COLLAPSIBLE TUBE COMPRESSING PASTE DISPENSER

BACKGROUND OF THE INVENTION

This invention relates to an improved paste dispensing electric appliance for squeezing collapsible tubes to expell a usable quantity of the tube contents. The invention is useful in connection with paste materials, particularly toothpaste, packaged in collapsible tubes.

The toothpaste tube is a familiar item in most homes and the subject of, albeit somewhat exaggerated, much humor about exasperation of the use over the condition and location of the tube. The underlying truth of the humor is that the collapsible tube more often than not becomes a rather unsightly mess as the contents are used. An attractive household appliance that can dispense a small quanity of toothpaste upon command, enclose the paste tube to prevent countertop messiness and retain the tube in a fixed location would alleviate this household problem.

While many devices for mechanically squeezing such tubes are known, there appears to be a need for an improved paste dispensing device using a reduced number of interacting parts. Such a simplified design would result in a reduction of manufacturing cost and an increase in reliability of the device.

SUMMARY OF THE INVENTION

The object of the invention is to provide an easily operated, economical and reliable paste material dispenser for squeezing a collapsible paste tube. The invention provides an electrically powered dispenser enclosed in an attractive decorator housing. The paste tube is easily and quickly installed in the housing by threading the dispensing nipple of the tube into a dispensing adapter of the housing cover. When the cover is placed on the dispenser the tube becomes positioned for squeezing by a motor driven roller. Switch actuation of the motor is accomplished through a finger lever that includes dispensing adapter nozzle closure means.

DETAILED DESCRIPTION OF THE INVENTION

Figure 1:
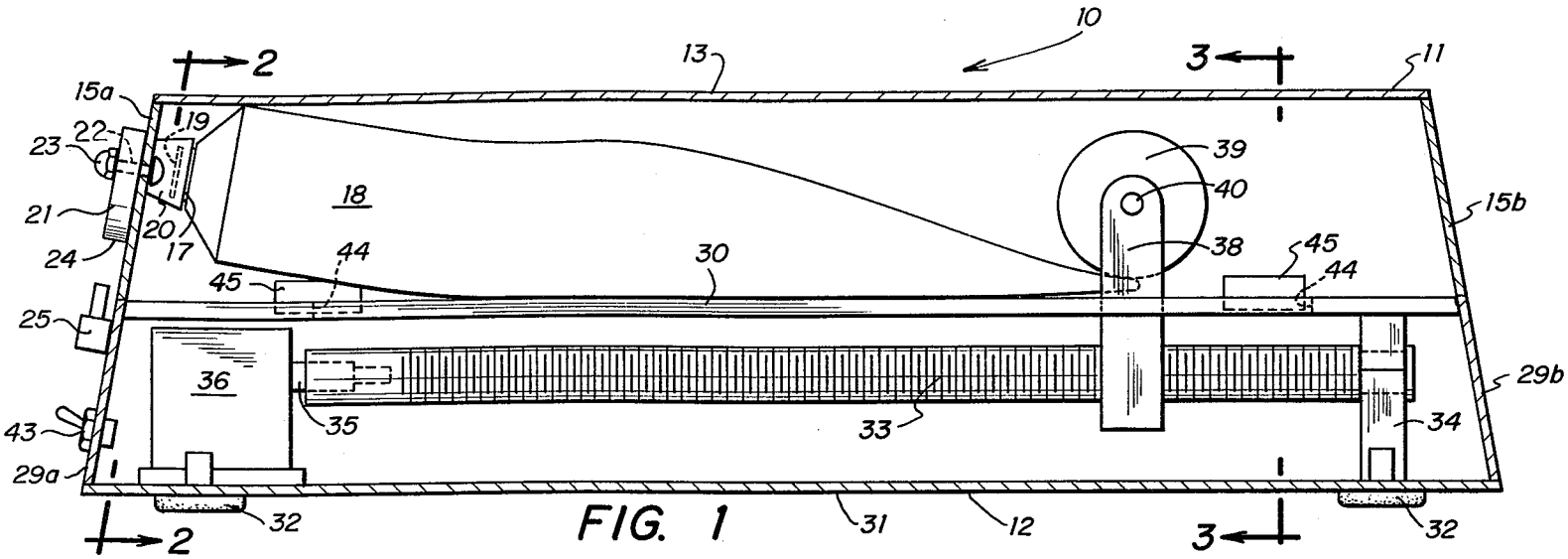
FIG. 1 is a side elevation view of the invention with the enclosure side walls facing the viewer removed.
Figure 2:
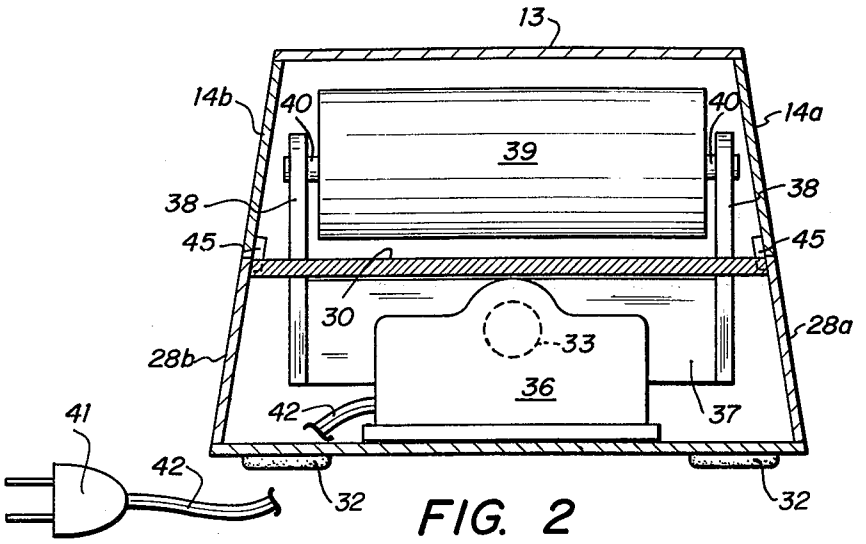
FIG. 2 is a cross-sectional elevation view taken along the line 2—2 of FIG. 1.
Figure 3:
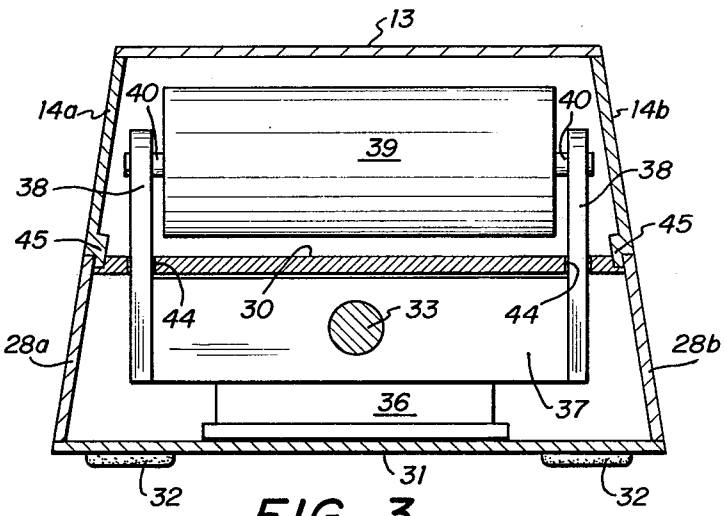
FIG. 3 is a cross-sectional elevation view taken along the line 3—3 of FIG. 1.
Figure 4:
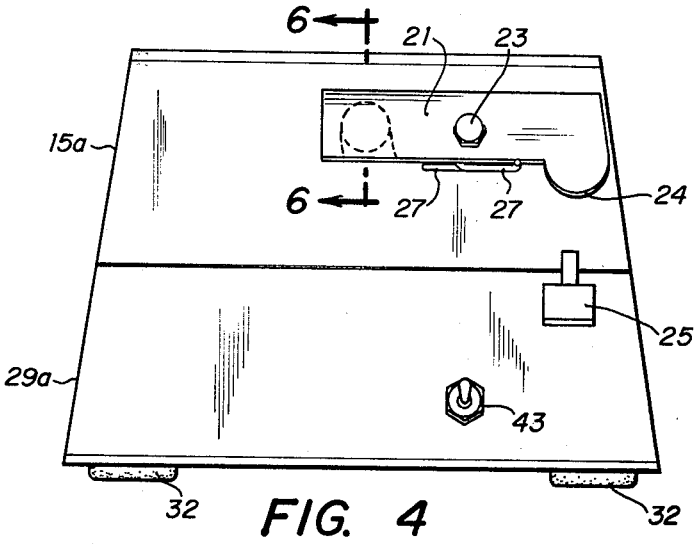
FIG. 4 is an end elevation view showing the switch actuation and nozzle closure lever in a rest position.
Figure 5:
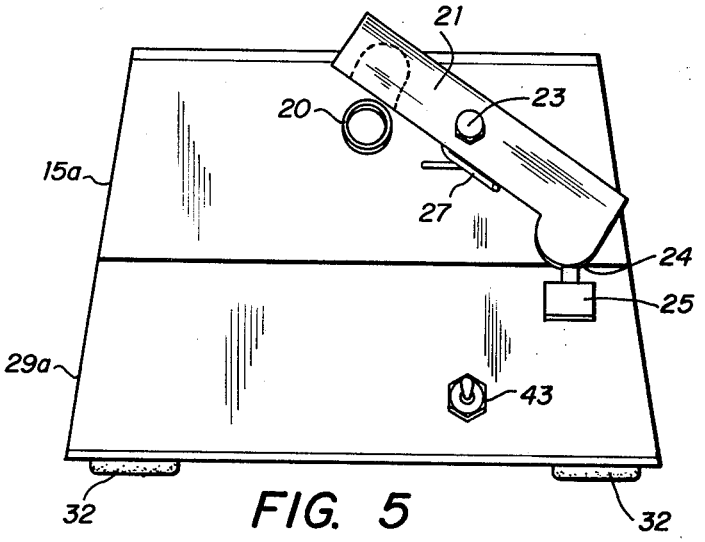
FIG. 5 is an end elevation view showing the switch actuation and nozzle closure lever moved to the active position, thereby opening the dispensing adapter nozzle and actuating the switch.
Figure 6:
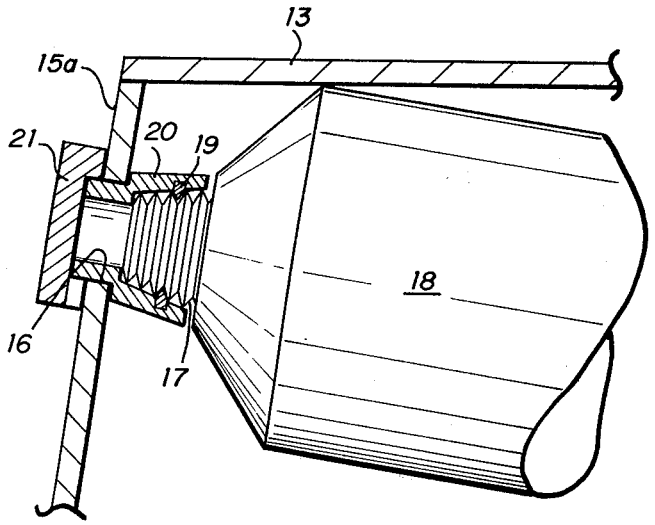
FIG. 6 is a cross-sectional view of the dispensing adapter nozzle and nozzle closure end of the lever taken along the line 6—6 of FIG. 4.

Drawing FIGS. 1 through 6 show the collapsible tube compressing paste dispenser 10 to have a top cover 11 and a base housing 12. The top cover 11 is formed by a top plate 13 affixed to opposing side walls 14*a* and 14*b* and opposing end walls 15*a* and 15*b*. End wall 15*a* has a circular aperture 16 through which is projected a dispensing adapter 20 connected to the dispensing nipple 17 of a collapsible paste tube 18. The dispensing adapter 20 includes a universal spring steel nut 19 into which dispensing nipples 17 of any of the commonly marketed sizes can be threaded to securely engage the dispensing adapter 20 to the dispensing nipple 17 and paste tube 18. The dispensing adapter 20 has a cylindrical forward nozzle diameter sized to fit snugly into and through the circular aperture 16, with a circumferential stop shoulder provided to limit the projection of the adapter 20 through the aperture 16. The threaded engagement of the tube nipple into the dispensing adapter 20 described also holds the paste tube 18 in a steady rest position within the dispenser 10, with the body of the tube 18 being vertically supported by a flat platen 30. On the external surface of the end wall 15*a*, a switch actuation lever 21 is rotatably mounted on a spindle 22 and held in place by a cap nut 23 threaded to the spindle. An end of the lever 21 has a integral cam 24 arranged to engage a push button of a contact switch 25 for actuation of the dispenser as later described. A recess 26 is constructed in the opposite end of the lever 21 to provide closure of the dispensing adapter nozzle 20 when the lever 21 is in the rest position, as shown in FIGS. 4 and 6. A hair spring 27, wrapped around the spindle 22 and stressed when the lever 21 is depressed by a downward force atop the cam end of the lever, as shown in FIG. 6, returns the lever 21 to the rest position when such force is removed. With the lever 21 depressed as shown in FIG. 5, the dispensing nipple 17 is open so that paste contents of the tube 18 can be expelled for use.

The base housing 12 is formed by a pair of opposing side walls 28*a* and 28*b*, a pair of opposing end walls 29*a*, and 29*b*, a flat surfaced roller platen 30 and a base plate 31, all interconnected to form an enclosure that is the base housing 12. Resilient mounting feet 32 are provided in the base plate 31 to dampen sound and vibration and to restrict movement of the dispenser 10 when positioned and operated on a flat surface, such as a counter top. Snap lugs 40 hold the base housing 12 and cover 11 firmly together while allowing simple, manual removal of the cover for insertion and removal of a paste tube 18.

A lead screw 33, positioned longitudinally within the base housing 12, is supported at one end by a horizontally split cradle 34 and at the opposite end by the shaft 35 of an electric gearmotor 36. A roller carriage 37, in threaded engagement with the lead screw 33, has upright support members 38 affixed at its opposite ends and projected upright through slots 44 in the platen 30. A tube compressing roller 39 is rotatably mounted between the upright support members 37 on stub axles 40. A collapsible paste tube 18, when threaded by the dispensing nipple 17 into the nut 19 of the dispensing adapter 20, is supported along its length by the platen surface 30. By causing the roller 39 to travel longitudinally along and above the platen 30, from the closed end of the tube toward the nipple end, the tube 18 can be compressed between the platen 30 and roller 30 and the paste contents thereby expelled.

The contact switch 25, having a spring-loaded push botton, when depressed through finger force on the end of the lever 21, makes and allows electric current, obtained from a standard household outlet through a plug 41 and conduit 42, to energize the gearmotor 36. A miniature motor with integral reduction gearing to provide slow shaft rotation is utilized. Through the direct connection of the gearmotor output shaft 35 to the lead screw 33, the lead screw 33 is rotated and the roller carriage thereby caused to travel along the length of the lead screw 37. It is obvious that the roller 39 thus travels longitudinally along the platen 30 and squeezes the paste tube. A toggle switch 43 is provided to reverse the electric motor 36 polarity and thereby cause the roller 33 to travel in the opposite direction for removal of a used tube and installation of a new tube of paste.

Whereas this invention is herein illustrated and described with respect to a particular embodiment, it should be realized that various changes may be made without departing from the essential contributions to the art made by the teachings hereof.

I claim:

1. A collapsible tube compressing paste dispenser, comprising, in combination:

(a) two pairs of opposed walls affixed one to another and to a slotted platen, said walls also being rigidly affixed to a baseplate, thereby forming an enclosure having two ends, two sides, a top being said platen and a bottom being said baseplate;

(b) a tube compressing roller, rotatably mounted between upper ends of two upright support members projected above the platen through two parallel slots so that the support members can travel longitudinally within the slots, and an internally threaded crossmember positioned below the slotted platen and having an end affixed to a lower end of one upright support member and an opposite end affixed to a lower end of the other upright support member, thereby forming a carriage for said roller;

(c) a single lead screw threaded through a threaded hole through said crossmember, supported at an end by a bearing means and supported at an opposite end by an output shaft of an electric gearmotor mounted within said enclosure, with said lead screw directly connected co-axially to the shaft of said gearmotor;

(d) a switch means interposed in an electric power supply wire means between an external electric power source and said gearmotor for actuation of said gear-motor and a second switch means connected to the supply wiring and to said gearmotor for reversing polarity and rotation of the gearmotor;

(e) a dispenser cover having a top wall affixed to a pair of opposed cover side walls and to a pair of opposed cover end walls, a circular hole through a first of said cover end walls sized to tightly fit around a cylindrical nozzle end of a dispensing adapter piece with thread means within a hole through said adapter piece;

(f) a switch actuation and dispensing adapter nozzle closure lever pivotally mounted on a spindle affixed to said first cover end wall 15*a* and having a return spring means mounted on said spindle in association with said lever.

* * * * *